US005951410A

United States Patent [19]

Butler et al.

[11] Patent Number: 5,951,410

[45] Date of Patent: Sep. 14, 1999

[54] APPARATUS FOR OBTAINING COMPOUND BENDING DATA OF A GOLF CLUB

[75] Inventors: Joseph Howard Butler, Cordova; Michael Joseph Twigg; Everett A. Byrd, both of Memphis, all of Tenn.

[73] Assignee: True Temper Sports, Inc., Memphis, Tenn.

[21] Appl. No.: 08/775,340

[22] Filed: Jan. 3, 1997

[51] Int. Cl.[6] ..... A63B 57/00

[52] U.S. Cl. ..... 473/223; 473/407

[58] Field of Search ..... 473/223, 225, 473/222, 221, 219, 289, 290, 407, 409, 199, 233, 232

[56] References Cited

U.S. PATENT DOCUMENTS

| | | | |
|---|---|---|---|
| 3,270,564 | 9/1966 | Evans | 473/223 X |
| 3,601,408 | 8/1971 | Wright . | |
| 3,792,863 | 2/1974 | Evans | 473/223 |
| 3,806,131 | 4/1974 | Evans | 473/223 |
| 4,158,853 | 6/1979 | Sullivan et al. . | |
| 4,160,942 | 7/1979 | Lynch et al. . | |
| 4,239,227 | 12/1980 | Davis . | |
| 4,306,723 | 12/1981 | Rusnak . | |
| 4,375,887 | 3/1983 | Lynch et al. . | |
| 4,558,863 | 12/1985 | Haas et al. . | |
| 4,713,686 | 12/1987 | Ozaki et al. . | |
| 4,789,160 | 12/1988 | Dollar, Jr. et al. . | |
| 4,891,748 | 1/1990 | Mann . | |
| 5,111,410 | 5/1992 | Nakayama et al. . | |
| 5,210,603 | 5/1993 | Sabin . | |
| 5,233,544 | 8/1993 | Kobayashi . | |
| 5,249,967 | 10/1993 | O'Leary et al. . | |
| 5,277,428 | 1/1994 | Goodwin et al. . | |
| 5,342,054 | 8/1994 | Chang et al. . | |
| 5,351,951 | 10/1994 | Hodgetts . | |
| 5,435,561 | 7/1995 | Conley . | |
| 5,441,256 | 8/1995 | Hackman . | |
| 5,471,383 | 11/1995 | Gobush et al. . | |
| 5,474,298 | 12/1995 | Lindsay . | |

OTHER PUBLICATIONS

"Golf The Scientific Way," 1995 ISBN 0–9519830–3–2, pp. 103–107, 113–115.

*Primary Examiner*—Michael O'Neill
*Attorney, Agent, or Firm*—Harness, Dickey & Pierce P.L.C.

[57] ABSTRACT

A data acquisition and display system 60 obtains a golfer's downswing parameters during a swing analysis examination. The system 60 includes a specialized golf club 62 which generates data when swung in a downswing motion for a period of time defined as a downswing period which terminates upon impact by a club head 68 with a golf ball 56. As the club 62 is swung by a golfer whose swing is being analyzed, the club deflects in certain directions relating to toe up or toe down conditions, and leading or lagging conditions, of the head 68 of the club. The system 60, through hardware and software, responds to these downswing conditions and determines various performance parameters associated with the swing analysis of the golfer. The parameters are displayed on a monitor 94 and are used to form a graph 126 showing instantaneous deflection levels during the downswing period. The displayed parameters and the graph 126 can be printed by a printer 118. The system 60 can also be used to observe the trajectory of the golf ball 56 and determine the travel distance of the ball.

22 Claims, 14 Drawing Sheets

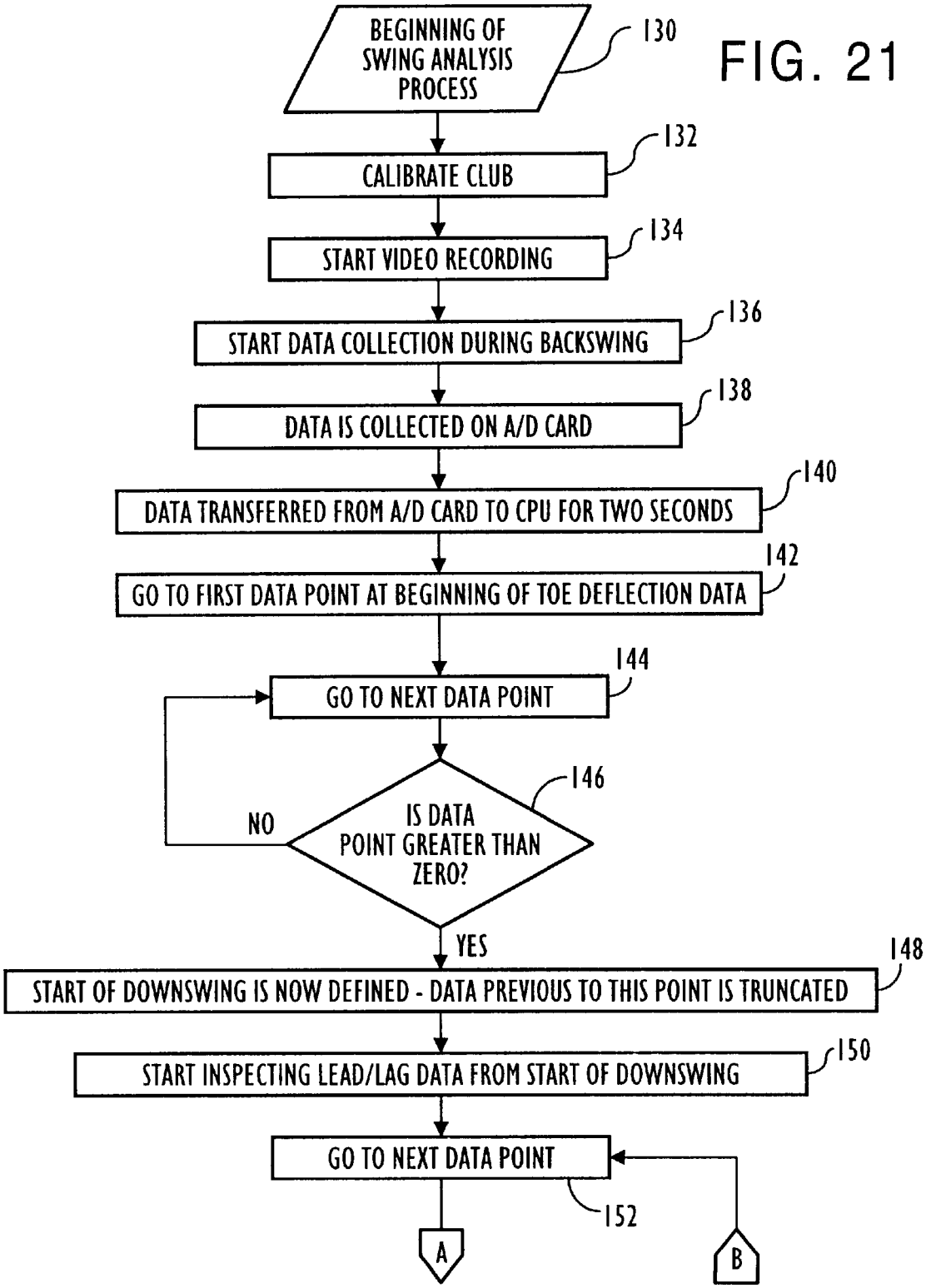
BEGINNING OF SWING ANALYSIS PROCESS
130
FIG. 21
CALIBRATE CLUB
132
START VIDEO RECORDING
134
START DATA COLLECTION DURING BACKSWING
136
DATA IS COLLECTED ON A/D CARD
138
DATA TRANSFERRED FROM A/D CARD TO CPU FOR TWO SECONDS
140
GO TO FIRST DATA POINT AT BEGINNING OF TOE DEFLECTION DATA
142
GO TO NEXT DATA POINT
144
IS DATA POINT GREATER THAN ZERO?
146
NO
YES
START OF DOWNSWING IS NOW DEFINED - DATA PREVIOUS TO THIS POINT IS TRUNCATED
148
START INSPECTING LEAD/LAG DATA FROM START OF DOWNSWING
150
GO TO NEXT DATA POINT
152
A
B

APPARATUS FOR OBTAINING COMPOUND BENDING DATA OF A GOLF CLUB

BACKGROUND OF THE INVENTION

This invention relates to a data acquisition and display system and particularly relates to the acquisition of prescribed data based on the swinging of a golf club and the display of data derived therefrom.

Golfing is a world wide sport with increasing popularity. With the increase in the golfing population, there is a significant increase in the number of players with a discerning demand for golf clubs which will improve and enhance their playing of the game. This demand goes well beyond those who play professionally and those in the upper levels of the amateurs.

Typically, some of the aspects of concern for the discerning golfer are the weight of the club, a balance between the flexibility and the stiffness of the shaft, and the torsional character of the shaft. The flexibility, or bending stiffness, requirements vary amongst golfers and relates to the golfer's "feel" of the club when the club is swung and upon impact with the ball. Typically, women and senior golfers use clubs which are more flexible, average players use a club with a mid-range flexibility, low handicap golfers use clubs of moderate stiffness while the professionals use clubs which are extra stiff. In response to the demand for different flexibility requirements, manufacturers have developed golf clubs having shafts of different bending stiffnesses. These golf clubs have been categorized into a range of bending stiffnesses from which golfers may select the club most appropriate for them.

During the swinging of a golf club, significant bending of the shaft occurs. The bending factor of the shaft is an important aspect of the golfer's game because it has direct relation to the manner in which the club head strikes the ball and the travel of the ball. Thus, it becomes important that the golfer determine different parameters associated with the golfer's swing in order for the golfer to be able to intelligently select the appropriate club from the range of bending stiffnesses available to golfers today.

Notwithstanding the opportunity today for golfers to select clubs from the range of stiffnesses, such selection has always been one of the most subjective aspects of club fitting. It is believed that such a subjective technique has an effective success level of only fifty to sixty percent. Historically, many different techniques have been used such as swing velocity at impact, 5-iron distance, or "flex" feel during downswing. Unfortunately, these techniques fall short in defining the relevant parameters required to choose the correct flex for the particular golfer.

Consequently, there is a need for developing data relating to a particular golfer's swing and translating this data into parameters most related to the shaft bending stiffness which is most appropriate for the golfer. There is a further need to display the data in a useable format to assist the golfer in making the appropriate club selection.

SUMMARY OF THE INVENTION

It is, therefore, an object of this invention to provide a system which will accurately provide a golfer with selective data useful in the selection of golf clubs having a bending stiffness most appropriate for the golfer.

Another object of this invention is to provide a system which collects data from the swinging of a golf club, and impact with the ball by the club head, and for displaying the data in a readable format.

Still another object of this invention is to provide a system which collects data from the swinging of a golf club by a golfer and quickly provides the data in a format readable by the golfer.

With these and other objects in mind, this invention contemplates a data acquisition and display system which includes a golf club equipped with a sensing device which detects compound bending of the golf club in prescribed directions during a period when the club is swung prior to and during impact with a golf ball. The sensing device responds instantaneously to the compound bending of the club during the period and produces data representative of the compound bending. A calculator analyzes the data and calculates various parameters related to the compound bending of the club during the period which are representative of the bending of the club in the prescribed directions. A display is provided and responds to the results of the calculations by the calculator and displays the resultant data in digital format.

Other objects, features and advantages of the present invention will become more fully apparent from the following detailed description of the preferred embodiment, the appended claims and the accompanying drawings.

BRIEF DESCRIPTION OF THE DRAWINGS

In the accompanying drawings:

FIGS. 21 through 24 show a flow diagram representing the process, including software, of the acquisition and treatment of data by the system of FIG. 8, and the display of resulting parameters associated with the downswinging of the specialized golf club of FIG. 9 by a golfer in accordance with certain principles of the invention.

DETAILED DESCRIPTION OF THE PREFERRED EMBODIMENT

Figure 1:
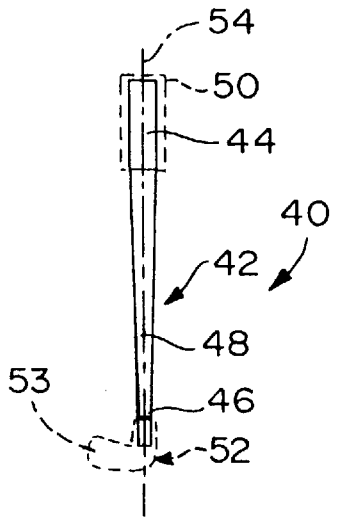
FIG. 1 is a side view of a shaft of a golf club with a head and a grip of the club shown in phantom.

Referring to FIG. 1, a golf club 40 includes a shaft 42 having a butt end 44, a tip end 46 and an intermediate section 48 extending between the butt end and the tip end. The butt end 44 is generally cylindrical having a prescribed uniform outside diameter and the tip end 46 is also generally cylindrical having a uniform outside diameter less than the prescribed diameter. The intermediate section 48 is uniformly tapered from the prescribed diameter at its juncture with the butt end 44 to its juncture with the tip end. A grip 50, which is shown in phantom, is assembled over the butt end 44 and a club head 52, which is also shown in phantom, is assembled on the tip end 46. The head 52 is formed with a forward end, or "toe," 53. Either or both the butt end 44 and the tip end 46 could be tapered. When not being swung, club 40 and shaft 42 are generally straight about a centerline 54.

Figure 2:
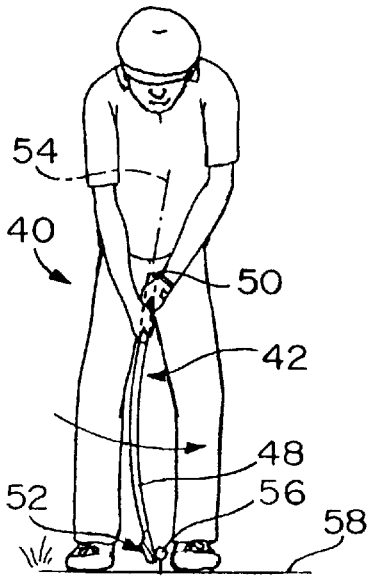
FIG. 2 is a front view showing the golf club of FIG. 1 being swung with the head of the club leading the normal centerline of the club at the point of impact with a golf ball resting on a surface.

One of the critical properties of golf clubs, such as club 40, which affects the play of a golfer using such clubs is the flexibility, or bending stiffness, of the shafts, such as shaft 42, which form a component of each such club. As the golf club 40 is swung by a golfer, the shaft 42 will tend to bend in different directions resulting in a compound bend during the swinging thereof and at the point of impact with a golf ball 56 (FIG. 2). This reaction which occurs during the swinging of the club 40, and in the form of the compound bend of the shaft, is referred to as "loading" the club and is directly related to the flexure, or stiffness, of the club. The compound bend of the shaft 42 influences the position of the head 52 upon impact with the ball 56 to the extent that the ball may travel in a path which detracts from the enjoyment of the game and which prevents the golfer from playing the game to best of the golfer's ability.

This characteristic of golf clubs was recognized many years ago and led manufacturers to make clubs available in a range of bending stiffnesses in an effort to enhance the golfers' playing of the game. While the compound bending effect was noticed, and resulted in the availability of clubs in a flexure range, the individual selection of such clubs based on flexure has been one of the most subjective aspects of fitting a golfer with clubs which are best suited to the golfer's ability and style of play. Historically, many different techniques have been used such as swing velocity, 5-iron distance and flex "feel" during the downswing of the club. Unfortunately, these techniques fall short in defining the relevant parameters required to choose the appropriate shaft and club for the individual golfer.

Figure 3:
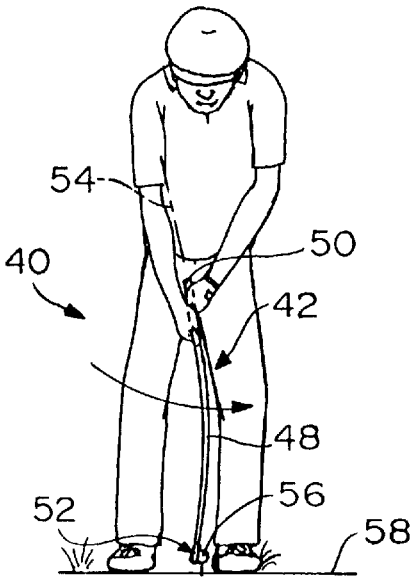
FIG. 3 is a front view of the golf club of FIG. 1 being swung with the head lagging the normal centerline of the club at the point of impact with the golf ball.

Referring to FIG. 2, the club 40 is being swung by the golfer and the club head 52 is poised for impact with the ball 56 which is resting on a playing surface 58. In this illustration, the head 52 has moved forward of the normal centerline 54 of the club 40 and is thereby in a "lead" position. As shown in FIG. 3, the club head 52 is being swung and is poised adjacent the ball 56 but the head trails the normal centerline 54 of the club 40 and is thereby in a "lag" position. The "lead" and "lag" positions are directly related to the flexure, or bending stiffness, of the club 40, and the shaft 42 in particular, and demonstrate a side to side bending of the club 40. Typically, the club head 52 is in the lag position during most of the downswing period and shifts to the lead position shortly before impact with the ball 56. However, the lead/lag information generated during the entire period of the downswing is important data which can be used by a golfer to assist in the selection of a set of clubs having shafts of the appropriate stiffness, or flexure, for that golfer.

Figure 4:
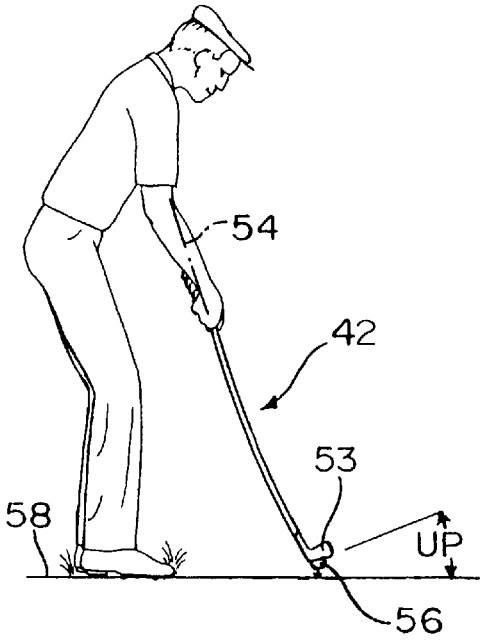
FIG. 4 is a side view showing the golf club of FIG. 1 with a forward end, or toe, of the head tilted upward at an angle relative to the surface at the point of impact with the golf ball.
Figure 5:
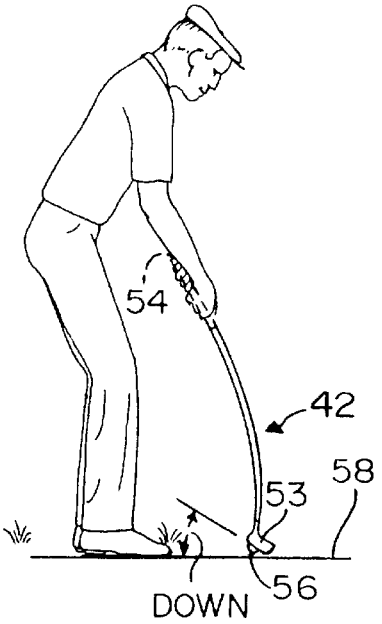
FIG. 5 is a side view showing the golf club of FIGS. 1 and 3 with the toe of the head tilted downward at an angle relative to the surface at the point of impact with the golf ball.

As shown in FIG. 4, the club 40 is viewed from the side in the swinging motion and is poised for impact with the ball 56. In this illustration, the shaft 42 is bent forward of the golfer such that the toe 53 of the head 52 is angled upward with respect to the playing surface 58. This is referred as a "toe up" condition. Referring to FIG. 5, the shaft 42 is bent toward the golfer during the swing of the club and is poised to strike the ball 56. Under this condition, the toe 53 of the head 52 is angled toward the playing surface 58 to illustrate a condition referred to as a "toe down" condition.

The "lead" and "lag" conditions and the "toe up" and "toe down" conditions are referred to as "the downswing parameters" and are directly related to the flexure, or bending stiffness, of the club 40. The downswing parameters provide, in a combinational sense, sources of information which can be useful to the golfer in the selection of a clubs based on the flexure of the shafts which form a part of such clubs.

Figure 6:
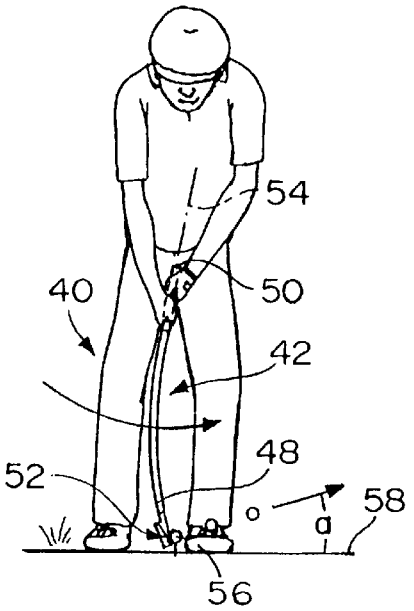
FIG. 6 is a front view of the golf club of FIG. 1 showing the club bent and the head tilted at such an angle that the ball assumes a relatively low trajectory when the head strikes the ball.
Figure 7:
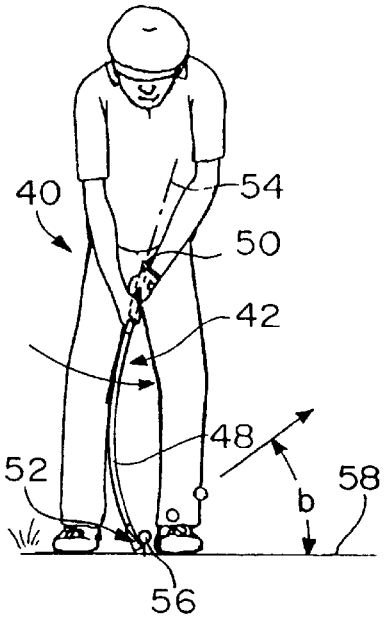
FIG. 7 is a front view of the golf club of FIGS. 1 and 5 showing the club bent and the head tilted at such an angle that the ball assumes a relatively high trajectory when the head strikes the ball.

Another parameter which is important to the golfer is the launch angle of the ball 56 which occurs at the point of impact of the club head 52 with the ball. Referring to FIG. 6, the club head 52 is in a "lead" position whereby the head is angled to project the ball 56 in a forward and upward trajectory, at an angle "a" with respect to the playing surface 58. As shown in FIG. 7, the club head 52 is in a different "lead" position whereby the head is angled to project the ball 56 in a forward and upward trajectory at an angle "b" which is greater than the angle "a." When striking the ball 56, there is an optimum launch angle at which the ball will travel the fartherest. Any launch angle above or below the optimum launch angle will not carry the ball 56 as far as the optimum launch angle. Flexure of the club 40 plays an important role in the amount of "loading" attained in the club during the swinging thereof and, consequently, in the "lead" angle of the club head 52 at the point of impact with the ball 56. Thus, flexure, or bending stiffness, of the club 40 is a very important criteria in the fitting golfers with the clubs which are most appropriate for the golfers' playing of the game.

Based on the foregoing analysis, it is important to recognize that structural strength and stiffness requirements of golf clubs are dependent on how the club is "loaded" during the downswing of the club and not on the how fast it is moving. Consequently, it becomes important to have a methodology which will measure the "load" applied to the club shaft 42 during the downswing of the club 40 and provide a load-profile plot and data for each tested golfer regarding the manner in which the shaft bends during the downswing of the club being swung by the tested golfer.

Ideally, a golfer will want to be able to repeat, or be consistent in arriving at, the same impact position between the club head 52 and the ball 56 for each and every swing of the club 40. While this is not going to happen in the best of circumstances, a golfer can move closer to this ideal if the "load" on their club 40, and shaft 42 can be determined with respect to the bending stiffness of the shaft. The more a golfer "loads" the shaft 42 during the downswing of the club 40, generally a stiffer shaft flex is needed by the golfer to optimize impact repeatability. While several other downswing parameters contribute to the flex requirement, the overall shaft-lateral "load" is extremely important. It appears that, if the shaft 42 deflects too much or too little during downswing, the average golfer with average athletic ability can not effectively repeat the golfer's impact position.

Figure 8:
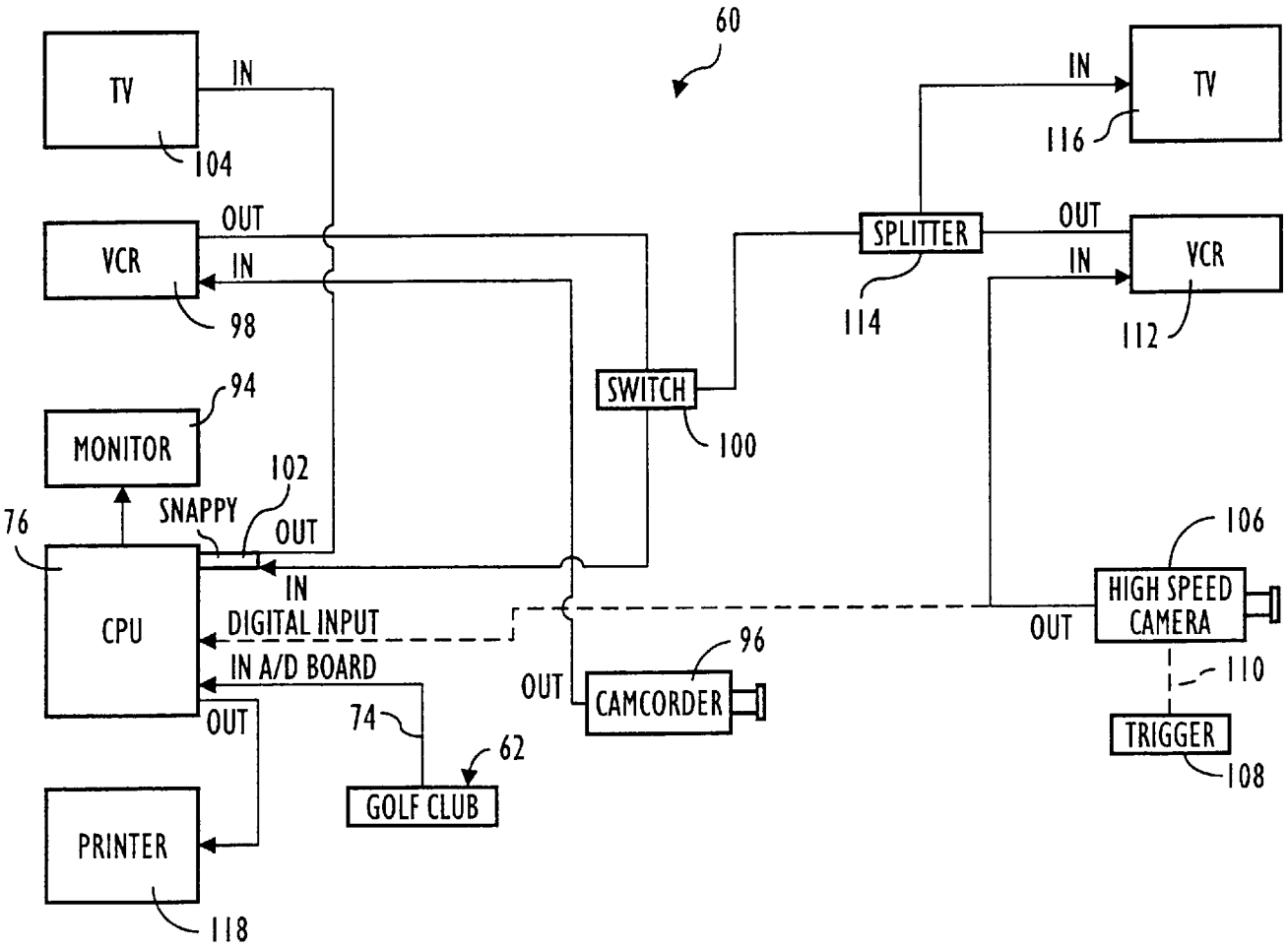
FIG. 8 is a block diagram of a system for acquiring data based on the swinging of a golf club, processing the acquired data into a prescribed format and displaying the data in a human-readable form in accordance with certain principles of the invention.

Referring to FIG. 8, a data acquisition and display system 60 is designed to acquire data from the downswing of a specialized golf club 62 (FIG. 9) by an individual golfer and to develop and display graphically and digitally the acquired data for use by the individual golfer. Such acquired and displayed data can be used in the selection of golf clubs with respect to the bending stiffness of such clubs. By use of the system 60, shaft fitting technology will move from the subjective technique, with an effective success level of fifty to sixty percent, to an objective technique with an effective success level of over ninety percent. From a practical standpoint, use of the system 60 in obtaining data, useful in the selection of clubs, will provide an opportunity for a golfer to perform closer to the golfer's maximum capability by optimizing the dynamic relationship with the golfer's clubs.

When a golfer swings the golf club 40, forces are applied to the club through the hands and body of the golfer. These forces cause the club 40 to move. Anytime a force is applied to the club 40 that causes it to move, neglecting friction, the club will accelerate. With respect to shaft 42, the more the club 40 accelerates, the more force or load that must be applied to the club. There are many types of shaft loads that occur during a downswing, including but not limited to bending and twisting of the shaft 42. The system 60 is primarily concerned with shaft bending in both the "toe up" and "toe down" conditions and the "lead" and "lag" conditions.

Figure 9:
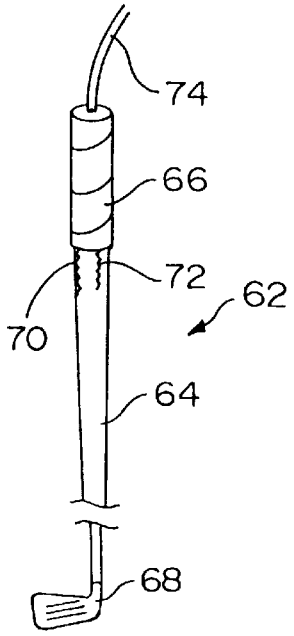
FIG. 9 is a perspective view of a specialized golf club having a pair of strain gages located on a shaft of the club in a selected orientation and spacing in accordance with certain principles of the invention.

Referring to FIG. 9, the specialized golf club 62 forms a data-gathering portion of the system 60 (FIG. 8) and includes a shaft 64, a grip 66 at the butt end thereof and a club head 68 at the tip end thereof. A pair of strain gages 70 and 72 are attached to the shaft 64 adjacent the juncture of the shaft and the grip 66. The strain gage 70 is located on the front of the club 62 and is in the plane of the club head 68 and the strain gage 72 is located on the side of the shaft 64 approximately ninety degrees from the location of the strain gage 70. The strain gages 70 and 72, which function as bending or deflection sensors, are aligned in a generally axial direction and are oriented so that the gages respond to bending of the shaft 64 in the manner illustrated in FIGS. 1 through 4. The strain gages 70 and 72 are connected individually to a small cable 74 which extends beneath the grip 66 and exits from the club 62 at the outboard extremity of the grip. In the preferred embodiment of the invention, a driver and a 5-iron are used in the manner illustrated in FIG. 9 with respect to club 62. The strain gages 70 and 72 as used in the preferred embodiment of the invention are commercially available as catalog No. BGI-350-0 from ADAC (American Data Acquisition Corporation) whose address is 70 Tower Office Park, Woburn, Mass. 01801. It is noted that clubs other than a driver and a 5-iron could be used, sensors other than the strain gages from ADAC, sensors other than strain gages could be used, and the location and orientation of the sensors could be different, all without departing from the spirit and scope of the invention.

As shown in FIG. 8, the system 60 includes the specialized golf club 62 which is connected through cable 74 to an analog-to-digital (A/D) board within a central processing unit (CPU) 76. The A/D board used with the preferred embodiment is identified as a 5580SCi Data Acquisition Board also available from ADAC (American Data Acquisition Corporation). Other A/D boards could be used without departing from the spirit and scope of the invention.

As analog data is generated through the strain gages 70 and 72 (FIG. 9) when club 62 is bent by "loading" (i.e., by swinging the club in a conventional manner), the data is fed through cable 74 to the A/D board in the CPU 76 where the data is converted from an analog format to a digital format. The digital data is representative of the "lead/lag" and "toe up/toe down" data as sensed by the strain gages 70 and 72 and is processed through software calculators within the CPU 76 in accordance with the flow diagrams as illustrated in FIGS. 21, 22, 23 and 24, and as described below.

Figure 10:
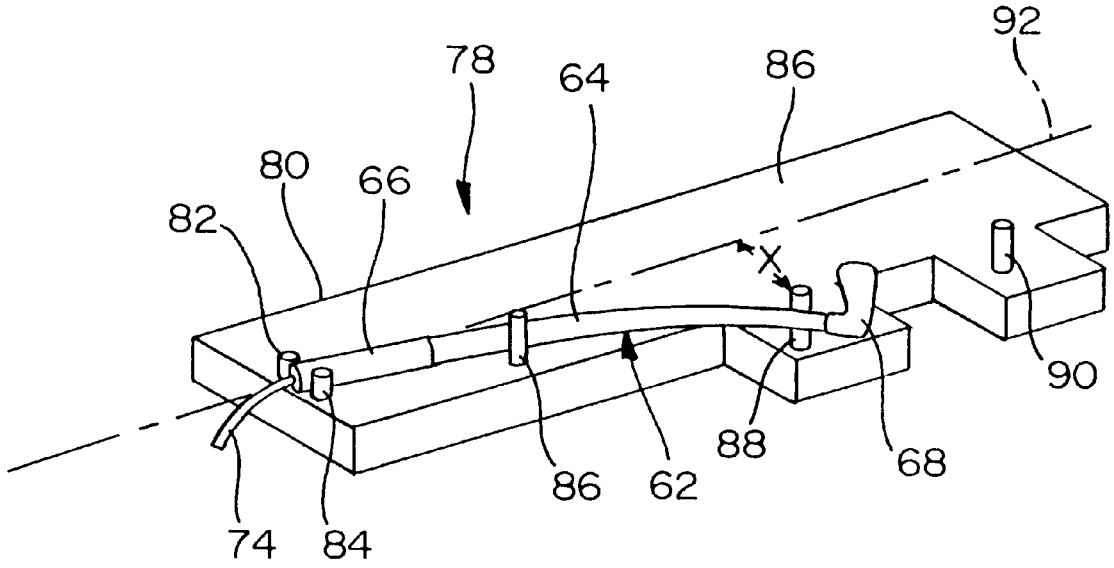
FIG. 10 is a perspective view of a calibrating device for calibrating the specialized golf club of FIG. 9 for use as a part of the system of FIG. 8 in accordance with certain principles of the invention.
Figure 13:
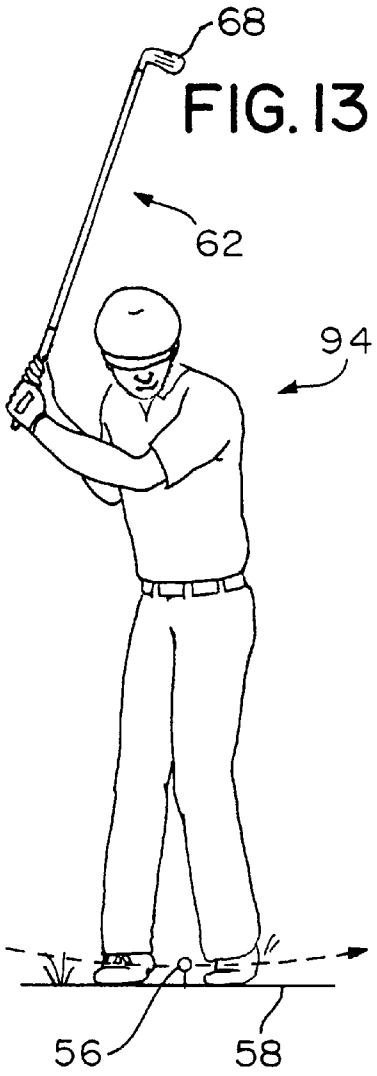
FIGS. 11 through 16 are front views showing a golfer swinging the golf club of FIG. 9, with FIG. 11 representing the beginning of the downswing, FIG. 16 representing club head impact with the ball and FIGS. 12 through 15 representing progressive advancement of the swinging of the club the positions between the positions illustrated in FIGS. 11 and 16.
Figure 12:
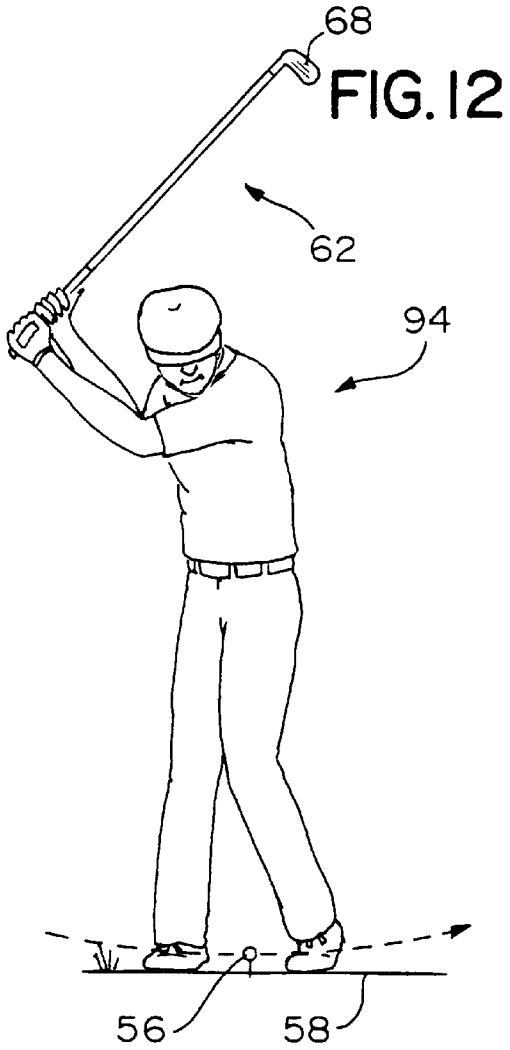

Referring to FIG. 10, a zero-adjust fixture 78 is used initially to calibrate the system 60 with the club 40. In particular, fixture 78 includes a flat base plate 80 having a first pair of pegs 82 and 84 extending upward from one surface 86 of the base plate and located at one end thereof. A third peg 88 extends upward from an intermediate portion of the surface 86 and fourth and fifth pegs 88 and 90 extend from side extensions of the plate 80.

In order to calibrate the strain gages 70 and 72 with the CPU 76, the cable 74 is connected to the CPU. The grip 66 is placed between the pegs 82 and 84 and the shaft 64 is placed against an inboard side of the peg 86. The portion of the shaft 64 adjacent to the head 68 is placed on an outboard side of the peg 88 so that the plane of the head is generally vertical and the club 62 is in a curved form. This simulates a condition associated with the "lead/lag" condition of the club 62 during the downswing period and bends the strain gage 72 accordingly. The peg 88 is located three inches from an imaginary measure line 92 which extends along the longitudinal center of the plate 80. With the club 62 in the curved position, the strain gage 72 responds to the bending of the shaft 64 as described and produces analog information representative of the bending. An adjustment is made by manipulating dials on the CPU 76 while observing a monitor 94 associated with the CPU to set a selected reading to a "zero." The placement of the club 62 in this curved form mimics the allowable condition of the curvature of the club during the downswing period with respect to the "lead/lag" condition from which the system 60 is calibrated.

Thereafter, the club 62 is manipulated so that the club head 68 is in a horizontal position whereby the strain gages 70 and 72 are bent in a different orientation than the previous calibration. In this curved position, the club 62 simulates a "toe up/toe down" condition whereby the strain gage 70 is bent accordingly. The portion of the shaft 64 which is adjacent the head 68 is again three inches from the measure line 92. A similar "zero" adjustment is made in the manner described above and the club 40 is now fully calibrated with the system 60 to proceed with the acquisition of data during the actual downswing period.

The peg 90 is located to accommodate a longer club such as a driver. In that instance, the portion of the shaft of the longer club would be placed on the outboard side of the peg 90 and the peg 88 would not be used.

Following the calibration procedure, a golfer 94, as viewed in FIGS. 11 through 16, will swing the club 62 through a downswing and impact with the ball 56. In preparation for the downswing cycle, the golfer 94 raises the club 62 over the golfer's head in the manner illustrated in FIG. 11 and swings the club through a series of positions as illustrated in FIGS. 12, 13, 14 and 15 and into the impact position of FIG. 16 where the club head 68 impacts the ball 56. During the downswing period, a standard video camcorder 96 is video recording the golfer 94 in the continuous swinging motion from FIG. 11 to FIG. 16. The camcorder 96 used in the preferred embodiment is identified as Model No. PV-IQ404 currently available from Panasonic. Camcorders from other manufacturers could be used without departing from the spirit and scope of the invention.

The video data is fed to a VCR 98 where it is recorded on a video cassette tape for preservation and subsequent recall and display. The video data stored on the tape within the VCR 98 can be recalled and fed through a splitter switch 100 to a commercially-available, pre-programmed image acquisition unit 102 where the data is formatted for reception by the CPU 76 in a form which represents, in a "still-shot" context, each frame of video observed by the camcorder 96 and stored on the video cassette tape. In addition, the video data is correlated to coincide with timing data associated with the downswing period so that the precise time of the occurrence of each frame during the downswing period can be displayed with the actual video frame taken at that time. Further, shaft deflection data as defined below, associated with the timing data, can also be displayed with each respective frame. The output of the image acquisition unit 102 is fed to the CPU 76 and to a TV unit 104 with a monitor for selective visual observation by the golfer 94.

The image acquisition unit 102, and the software contained therein, is a commercially available unit and software commonly referred to as "SNAPPY" and is available as "Snappy Video Snapshot" from Play Incorporated, whose address is 2890 Kilgore Road, Rancho Cordova, Calif. 95670.

It is desirable for a golfer to know generally the travel distance of the ball 56 that the golfer can attain with each of the clubs in the complement, or set, of clubs normally used by the golfer. With such information, a golfer can then judge the distance between the lie of the ball 56 and the pin, or a desired destination for the ball on a long fairway, and then determine which club should be used to attain that distance. The system 60 includes the capability to provide the golfer with such travel-distance information as described below. When using the system 60 to obtain such information, any golf club, or clubs, can be used. It is preferable for the golfer to use the set of clubs which the golfer uses in playing the game of golf. However, it is to be understood that the conventional club 40, the specialized club 62 or any other club could be used to obtain the desired information through use of the system 60 without departing from the spirit and scope of the invention. In the following description of obtaining the travel-distance information, reference will be made to the conventional club 40 for the purpose of consistency in the description.

Referring again to FIG. 8, the facilities of the system 60 for obtaining the travel-distance information includes a high speed camera 106. The camera 106 is physically positioned to take a series of high speed pictures of the golfer during the downswing of the club 40 just before, during and after impact with the ball 56. The camera 106 used in the preferred embodiment is identified as a "FlashCam X10" available from The Cook Corporation whose address is 600 Main Street, Tonawanda, N.Y. 14150.

Figure 18:
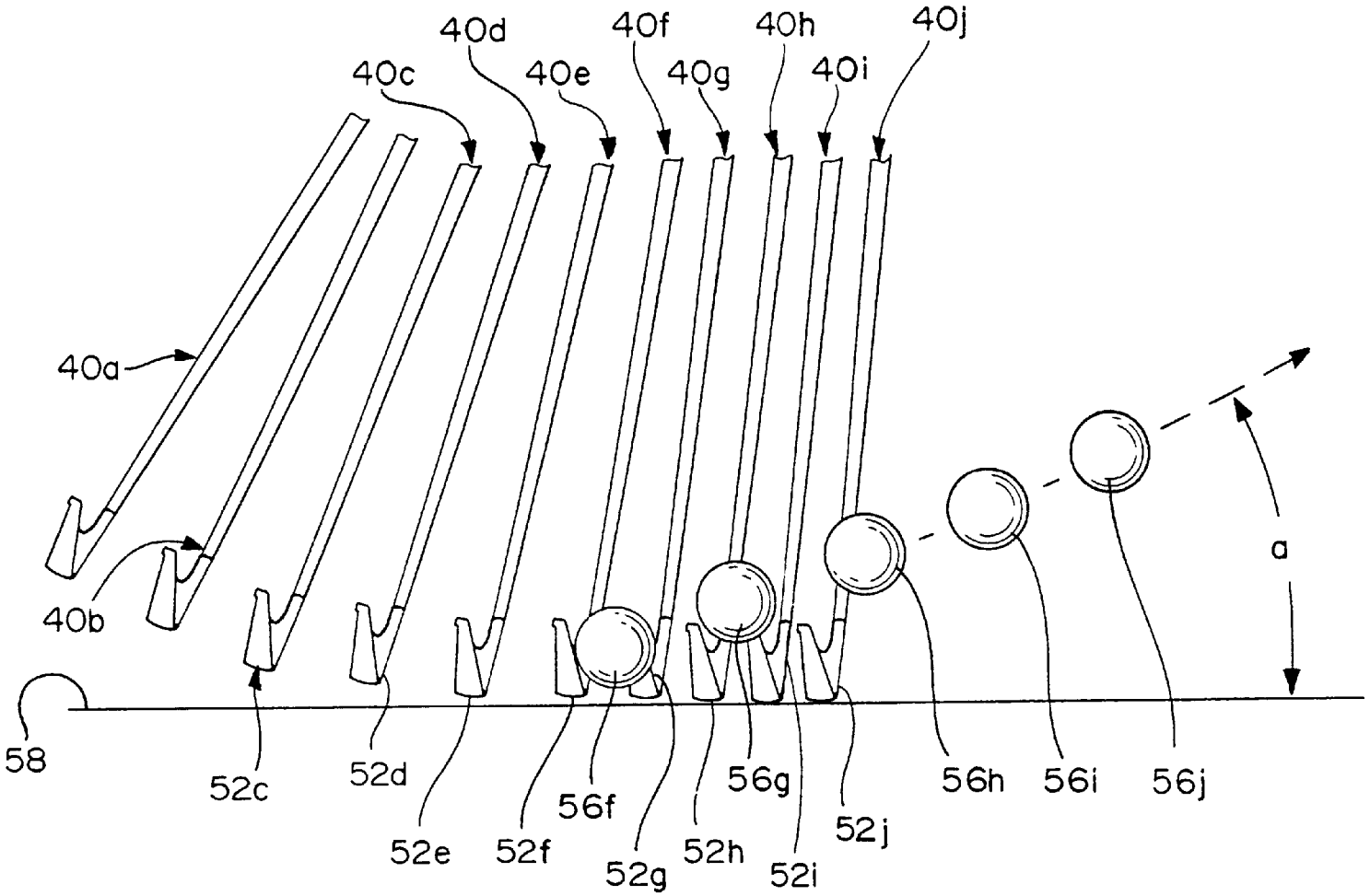
FIG. 18 is a front view of a representation of a single photograph showing one aspect of the system of FIG. 8 wherein a series of high-speed successive camera shots are taken of a golf ball being struck by a head of a golf club head thereby driving the ball into an illustrated trajectory.

An infrared camera trigger 108 is positioned physically near the camera 106 and directs an infrared beam 110 toward the camera where the beam crosses the downswing path of the golf club 40. The beam 110 is located in a plane which is near the point of impact between the club head 52 and the ball 56. Referring now to FIG. 18, a series of successively different positions of the club 40, head 52 and ball 56 are illustrated to represent the series of photographic shots taken by the high speed camera 106. The series of photographic shots are superimposed onto a single picture to reveal the relative positioning of the club 40, head 52 and the ball 56 during the period when the camera 106 is in the operating mode.

When the club 40 initially crosses through the infrared beam 110, the camera 106 begins to take the pictures for a prescribed time. The first picture taken is represented with the club being designated as 40*a* and successive pictures being designated as 40*b* through 40*j*. The club head 52 is also designated accordingly, that is, 52*a* through 52*j*. The point of impact occurs when the club 40*f* and head 52*f* strike the ball, the ball at impact being designated 56*f* for consistency. The infrared camera trigger 108 used in the preferred embodiment is identified as VIS II Trigger also available from The Cooke Corporation.

In the photographs which were taken following impact of the head 52 with the ball 56, the ball moves forward of the head 52 but the alphanumeric scheme of FIG. 18 provides indication of the relative locations of the club 40, the head and the ball for each picture taken. Yet, the ball 56*j* is considerably ahead of the head 52*j* and the club 40*j*. The series of successive illustrations of the ball 56*f* through 56*j* combine to reveal the launch angle "a" for the trajectory of the ball 56.

The data derived from the series of pictures taken by the camera 106 is fed to a VCR 112 and stored on a video cassette tape therein. The illustrations stored on the tape of the VCR 112 can be fed through a splitter 114 to a TV monitor 116 for visual observation. Or, the tape illustrations can be fed from the VCR 98 through the splitter 114, through the switch 100 and then to the image acquisition unit 102 for software formatting in preparation for processing in the CPU 76. Software within the CPU 76 analyzes and processes this video based data and displays it in the form of numerical parameters based on the trajectory angle "a" as shown in FIG. 18. The parameters include the distance in yards that the ball 56 travels, the height at the apogee and the location of the apogee as measured along the surface over which the ball travels. Based on the launch angle "a," and on empirical data, the software of the CPU 76 provides a "roll factor" which can be used to determine generally the distance of travel of the ball 56 after it hits a dry surface for the first time following impact with the head of the club.

Figure 19:
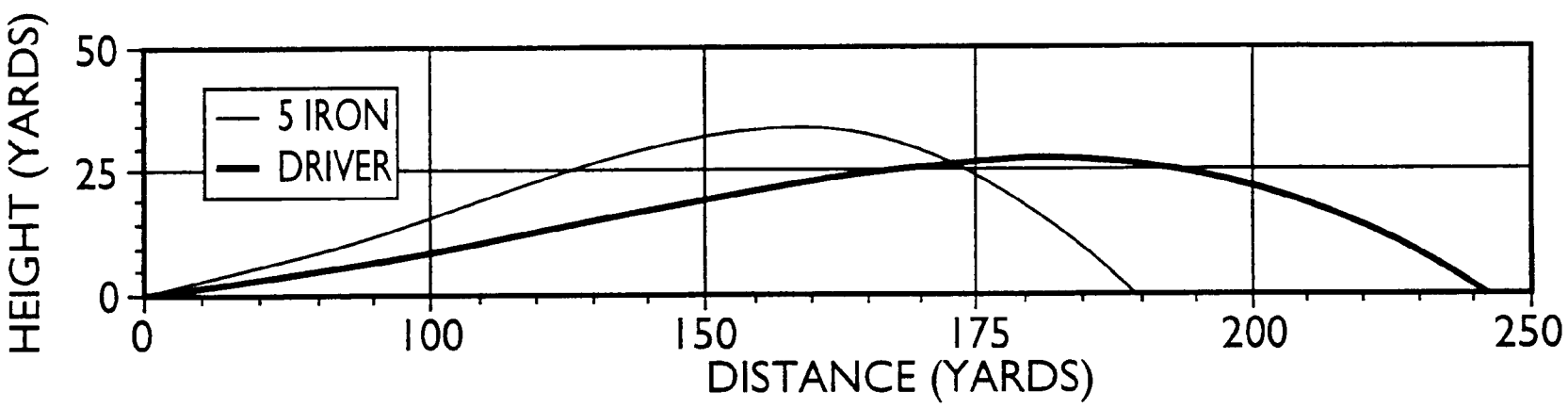
FIG. 19 is a graph showing the distance of travel and the height during travel of the golf ball of FIG. 18 when using a driver or a 5-iron and as calculated by the system of FIG. 8 in accordance with certain principles of the invention.

When a golfer uses the specialized club 62 as a driver or as a 5-iron to obtain the travel-distance information, the software of the CPU 76 determines the parameters noted above and controls the printer 118 to print a graph as shown in FIG. 19. The graph for the driver is shown in the darker line and represents a travel distance of approximately 242 yards and an apogee of about 28 yards. The graph for the 5-iron is the lighter line and represents a travel distance of about 189 yards and an apogee of about 35 yards.

While the golfer can use the specialized club 62 to obtain the travel-distance information, it would be prudent for the golfer to use the golfer's personal clubs for obtaining such information. This would allow the golfer to select a particular club for a desired travel distance when actually playing the game of golf. For example, assume that a golfer has nine irons in the golfer's complement of clubs. The golfer would use the system 60 in the manner described above with each of the nine irons. Each iron could be used several times to provide sufficient data to obtain an average of the travel distance for that particular club. The system 60 would process the data in the manner noted above and print the graph illustrated in FIG. 20 for the nine irons.

Figure 20:
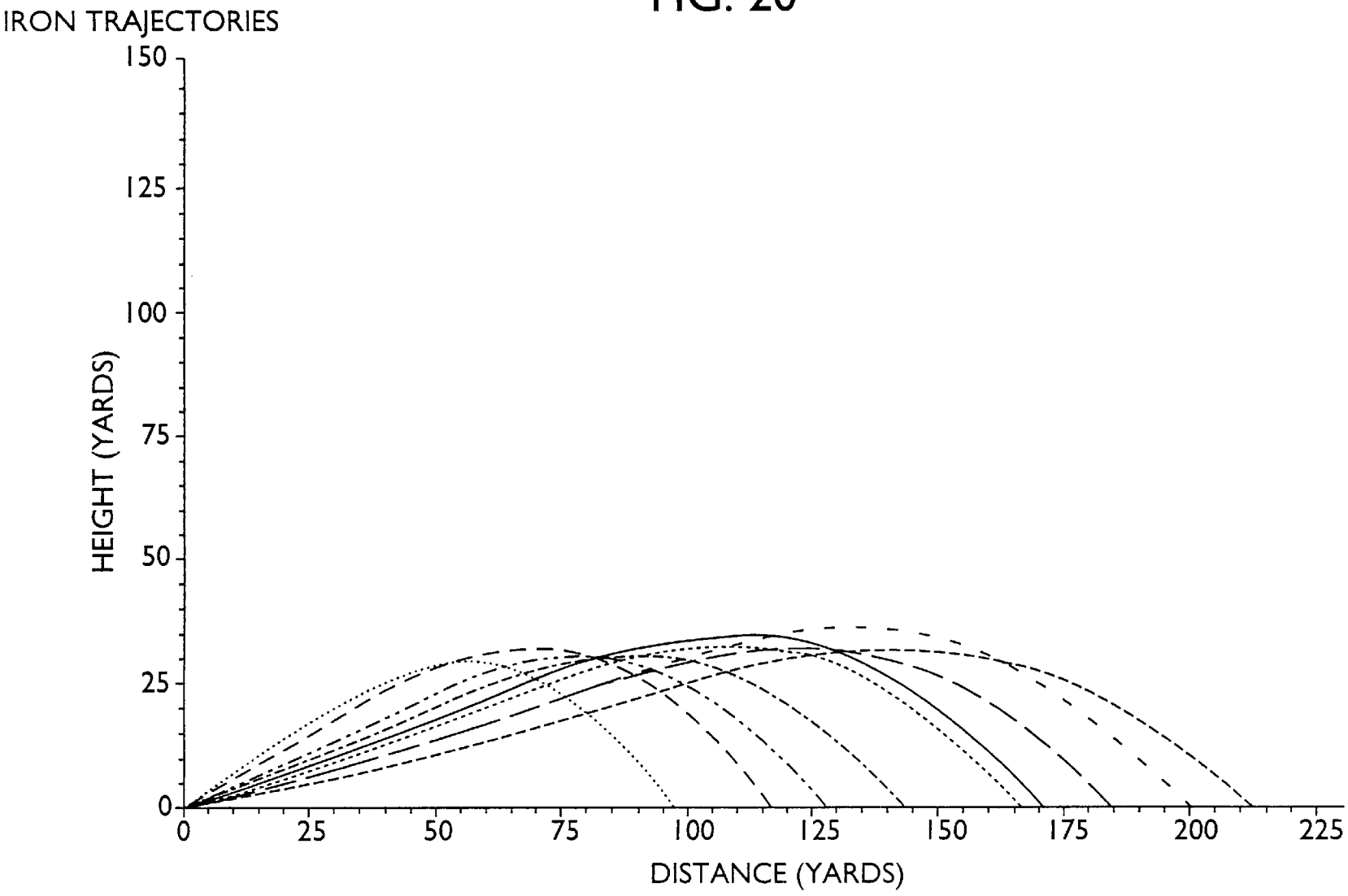
FIG. 20 is a graph of nine curves showing the distances of travel and the heights during travel of golf balls struck by a golfer using the golfers full set of irons.

The graph of FIG. 20, shows nine lines of different character representing the travel distance information for each respective club of the golfer's set of nine irons. The shortest average distance shown on the graph is about 97.7 yards as attained by use of the sand wedge (SW) and the next-to-the-shortest average distance shown in the graph, 116.6 yards, was attained by use of the pitching wedge (PW). The longest average distance shown on the graph is 212.9 yards which was attained by use of the 3-iron with the remaining six average distances being attained, in descending order by distance travelled, by the 4-iron as the highest of the remaining six and the 9-iron as the lowest of the remaining six.

To assist the golfer when playing the game of golf, a travel-distance card can be printed by the printer 118 to display the average travel-distance information as illustrated in Table I below.

TABLE I

| CLUB | CARRY |
|---|---|
| I3 | 212.9 |
| I4 | 200.7 |
| I5 | 184.6 |
| I6 | 170.6 |
| I7 | 166.6 |
| I8 | 143.2 |
| I9 | 127.9 |
| PW | 116.6 |
| SW | 97.7 |

In Table I above, the 3-iron through the 9-iron are indicated by "I3" through "I9," respectively, the pitching wedge by "PW" and the sand wedge by "SW." The "CARRY" column represents the average distance in yards as determined by the system 60 for each club.

When playing the game of golf, the golfer can carry the travel-distance card and refer to the card from time to time when deciding which club to use to attain a specific travel distance. For example, if the golfer estimates that the ball has to travel a specified distance to reach the pin, or a distant location on a long fairway, the golfer reviews the card and selects the club closet to the estimated distance.

"Downswing" software of the data acquisition and display system 60 is used to determine various downswing parameters noted below which relate to the deflection of the club 62 in the context of the lead/lag conditions and the deflection of the head 68 in the context of the condition of the head. A flow diagram representative of the downswing software is illustrated in FIGS. 21, 22, 23 and 24. This software, which is stored in the CPU 76, establishes a data collection period and analyzes and massages the various data obtained during the collection period and, in conjunction with the CPU, functions as a calculator and determines eight downswing-related parameters which are noted below.

Referring to FIG. 21, the system 60 is initialized as indicated by box 130 to begin the process leading to the collection of data based on the downswing of the specialized club 62, for example the driver or the 5-iron, and the impact of the club head 68 with the golf ball 56. As indicated in box 132, the club 62 is placed in the fixture 78 (FIG. 10) where the club is stressed so that the strain gages 70 and 72 are stressed in the manner described above. During this adjustment period, an operator sets the CPU 76 to a "zero" reading, as described above, whereby the club 62, and more particularly, the strain gages 70 and 72, are calibrated in conjunction with the CPU 76. Thereafter, as indicated in box 134, the operator initiates operation of the camcorder 96 to video record the downswing of the club 62 and the impact with the ball 56. The data derived from the video recording is fed from camcorder 96 to the VCR 98 which stores images on tape at a rate of thirty frames per second for subsequent recall.

Figure 11:
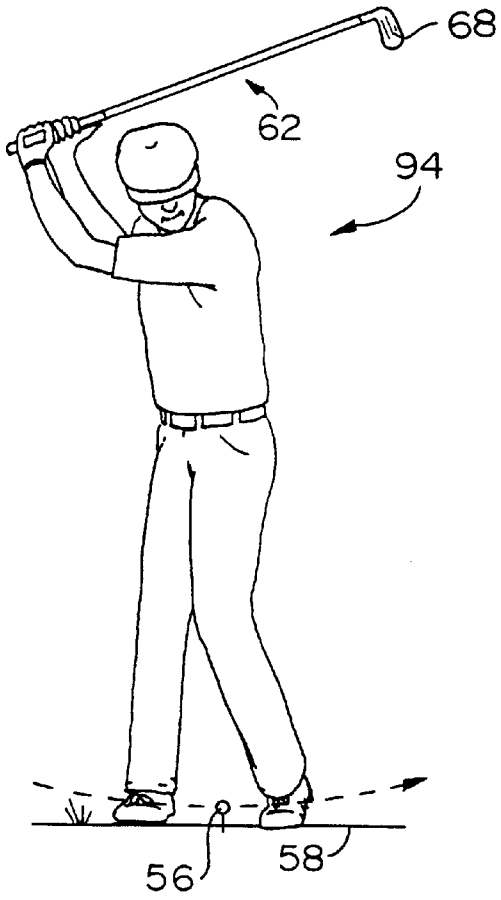

In preparation for the downswing and impact, the golfer 94 addresses the ball 56 with the club 62 in normal fashion and then begins and completes the backswing, sometimes referred to as the "takeaway," to the position illustrated in FIG. 11 where the golfer is ready to begin the downswing of the club. During the backswing period, and as provided in box 136, the operator closes a switch to place the system 60 in condition for the data collection process. At this time, as indicated in box 138, the A/D card at the input of the CPU 76 begins to read the data representative of the stresses placed upon the strain gages 70 and 72 resulting from the bending and twisting of the club 62 during the downswing of the club. As noted above, the strain gage 70 provides data relating to the lead/lag condition of the club 62 while the strain gage 72 provides data relating to the toe up/toe down condition of the club. The A/D card constantly reads the data derivable from the strain gages 70 and 72 at a rate of 1000 shaft-deflection values per second from each gage. Consequently, there are two streams, or data sets, of deflection values being read by the A/D card for subsequent use in determining eight changing parameters occurring during the period between the beginning of the downswing of the club 62 and the impact with the ball 56.

The eight changing parameters derived from the shaft-deflection values are:

1. Downswing Time—The duration in seconds between the start of the downswing and the time of impact.

2. Peak Toe—The highest amount of positive deflection (toe up) during the downswing in the toe up/toe down plane.

3. Peak Deflection—The greatest amount of deflection (positive or negative) during downswing in either the toe up/toe down plane or the lead/lag plane.

4. Maximum Droop—The greatest amount of negative deflection (toe down) during the downswing in the toe up/toe down plane.

5. Droop at Impact—The greatest amount of negative deflection (toe down) at the time of impact.

6. Droop Difference—The absolute difference between the maximum droop value and the droop value at the time of impact.

7. Lead at Impact—The amount of forward (positive) deflection in the lead/lag plane at the time of impact.

8. Kick Velocity—The value in miles per hour that the club contributes to (in addition to the club head speed) the balls initial velocity.

The data derived from the strain gage 70 is referred to as "the toe deflection data" and the data derived from the strain gage 72 is referred to as "the lead/lag data." Each of the deflection values for each of the toe deflection data and the lead/lag data is referred to as "a data point."

As indicated in box 140, the raw data stored in the A/D card is transferred to the CPU 76 for a period of two seconds. It has been determined by historical analysis that the collection of data for the period of two seconds provides a window sufficient to capture the required data between the beginning of the downswing of the club 62 to impact with the ball 56. Thus, about 2000 data points of information have been selected from each of the toe deflection data and the lead/lag data for analysis to determine the above-noted eight parameters. The 2000 data points for each of the toe deflection data and the lead/lag data represent a "data set" as noted above.

When the golfer 94 has moved the club 56 fully through the backswing to the position shown in FIG. 11, the golfer is in position to begin the downswing. As described above, the process of collecting data through the strain gages 70 and 72 is initiated during the backswing, or takeaway, period. This is done to insure that system 60 is in the data collecting mode at the initiation of the downswing by the golfer 94. Under these circumstances, the early collected data represents the trailing portions of the backswing period, expressed as values other than zero, and/or an instant of rest before the golfer 94 begins the downswing, expressed as zero values. In order to insure that only the downswing data is used in the analysis process, all data points developed prior to the beginning of the downswing will have to be discarded. This is accomplished in boxes 142, 144, 146 and 148.

As shown in box 142, the CPU 76 seeks the first data point of the toe deflection data, and then steps to a "first" next data point as indicated in box 144. The data point in box 144 is examined in decision box 146 to determine whether it is greater than zero. If the examined data point is not greater than zero, a "no" response is looped back to box 144, and a "second" next data point is selected and examined as indicated in box 146. This process of examination is continued until the first data point greater than zero is located and a "yes" response defines the start of the downswing in terms of a data point as indicated in box 148, where all previous data points are truncated. Note that the determination of the start point of the downswing by use of the toe deflection data also translates to the downswing start point for the lead/lag data. Therefore, a similar process with respect to the lead/lag data is not required.

The next action to be defined is the moment of impact of the club head 68 with the ball 56 which is coincidental with the completion point of the downswing period. Historically, it is known that the club head 68 typically lags the centerline of the shaft 64 during most of the down swing period. However, immediately prior to the impact of the club head 68 with the ball 56, the head moves forward of the shaft centerline due to a "kicking" or whipping action and thereby leads the shaft centerline. At the moment of impact of the head 68 with the ball 56, however, the head abruptly moves to a lagging position, thereby signalling the completion of the downswing period. The data derived during the downswing period, between the start point and the completion point thereof, are used to accurately determine the eight parameters noted above.

Figure 22:
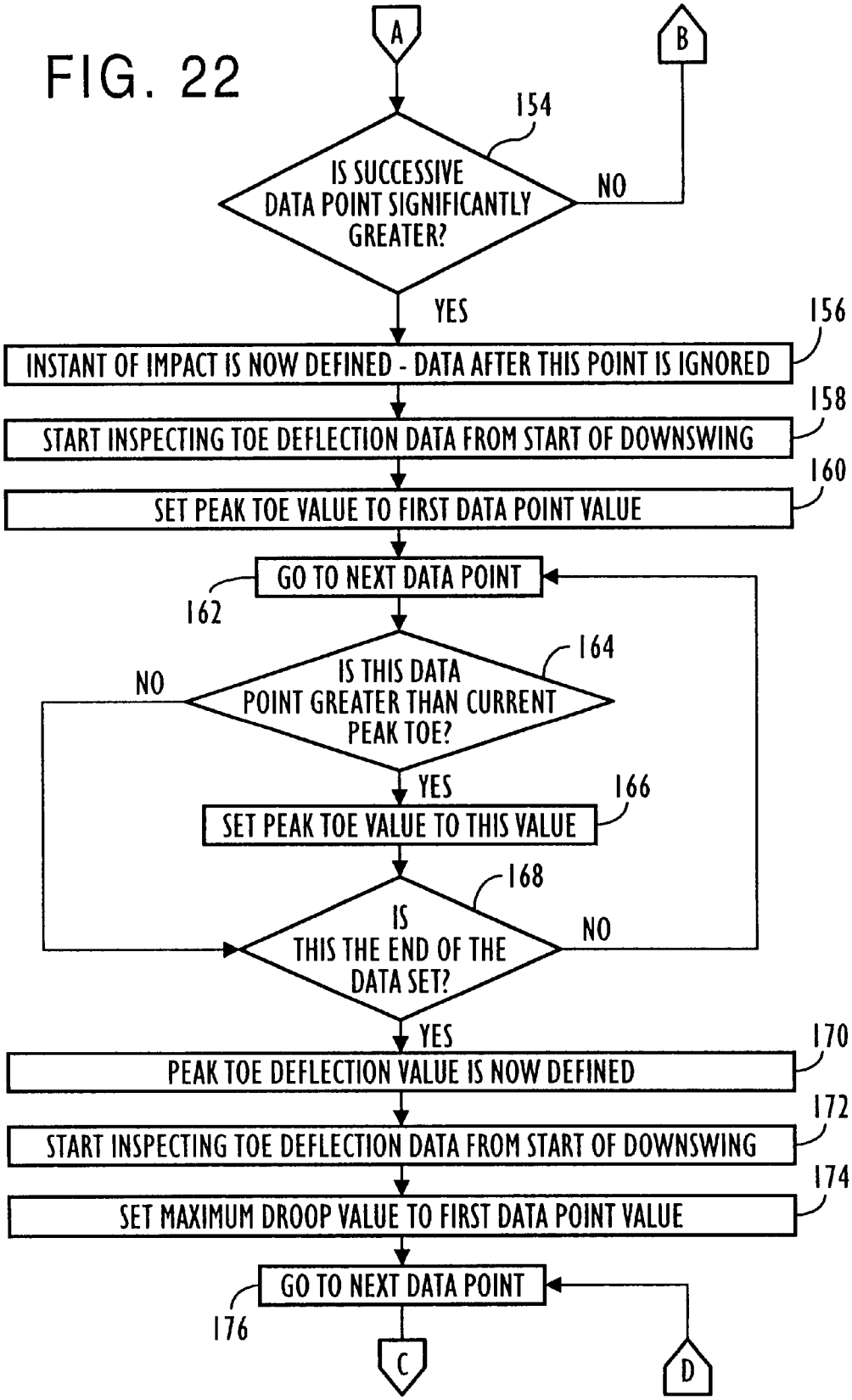

In determining the downswing completion point, and as indicated in box 150, the lead/lag data is inspected continuously from the beginning of the downswing of the club 64, which is determined in the manner noted above. As indicated in box 152 (FIG. 21) and 154, which is shown in FIG. 22, successive data points of the lead/lag data are examined to determine whether each successive data point is significantly greater than the previous data point. When a region of extreme acceleration is located, the peak of the region represents the instant of impact which defines the completion point of the downswing with respect to a data-gathering period. The instant of impact is now recorded in box 156 (FIG. 22) and any data incidentally collected after this instant, resulting from the follow through of the downswing motion, is ignored and forms no part of the eventual calculation of the eight parameters noted above.

By defining the instant of impact, the period of the downswing is now defined as occurring between the starting point of the downswing by use of the toe deflection data and the completion of the downswing period by use of the lead/lag data.

Referring further to FIG. 22, the instant of impact is recorded in box 156. Thereafter, in box 158, the toe deflection data is inspected from the start of the downswing period. In box 160, the peak toe value is set at the first data point collected at the beginning of the downswing period and represents the current peak toe deflection value. In box 162, the next, or second, data point is brought up and, in box 164, is compared with the first data point to determine whether the second data point is greater than the peak toe value set in box 160 based on the first data point. If the second data point is greater than the current peak toe value based on the first data point, box 166 responds by setting a new current peak toe value. If, as determined in box 164, the second data point is less than the peak toe value based on the first data point, or if a new peak toe value has been set in box 166, a determination is made in box 168 as to whether the end of the downswing period, or the data set, has occurred.

If the end of the data set has not occurred, the program loops back to box 162 to go to the next, or third, data point. The data associated with the third data point is then compared with the data of the second data point in the same manner noted above with respect to the first and second data points. This process is continued until it is determined in box 168 that the end of the data set has occurred. The toe deflection value currently stored in box 166 is thereby determined to be the peak value and is recorded in box 170.

Figure 23:
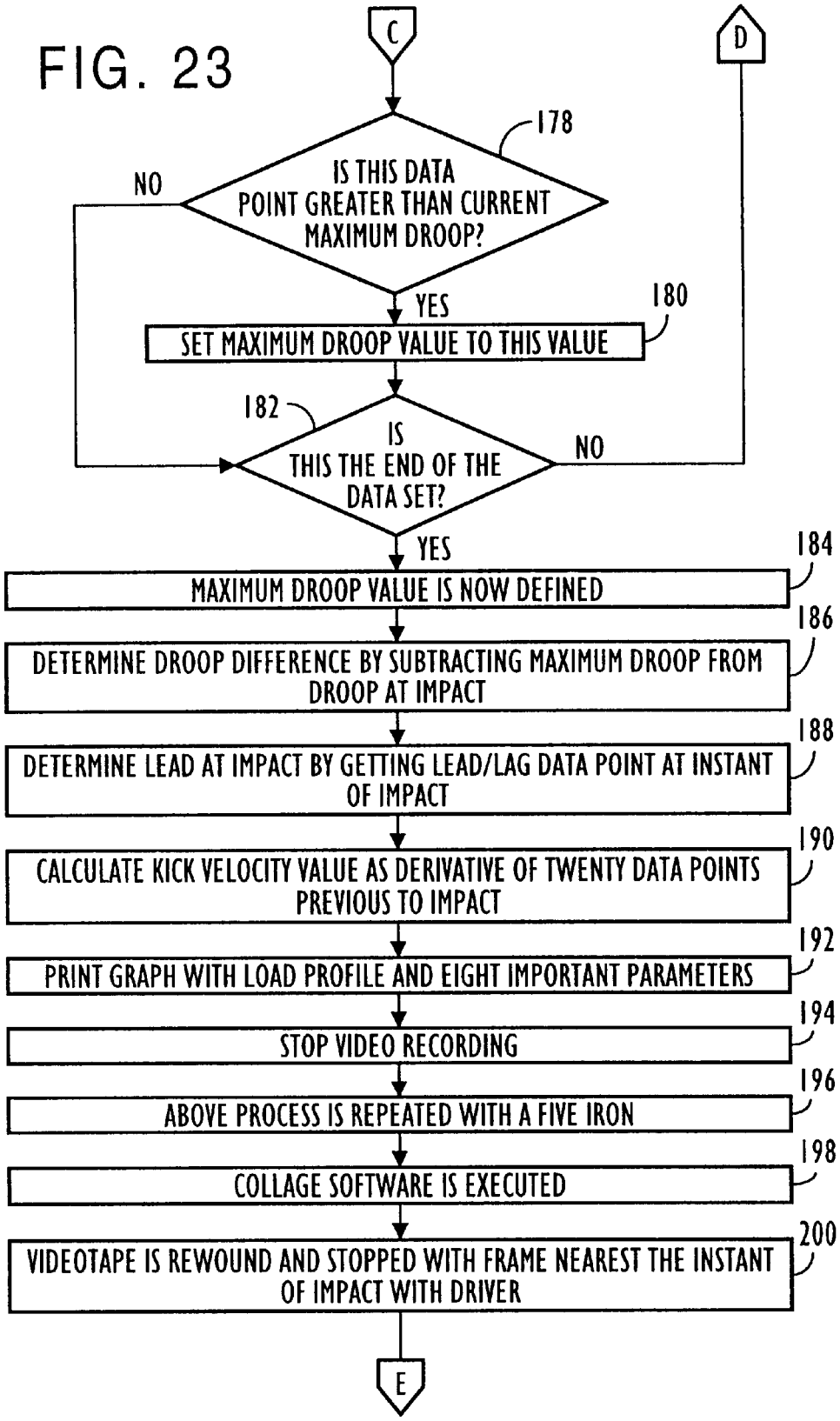

The toe deflection data is again examined in box 172 from the start of the downswing period. The first data point value is set in box 174 as representing the current maximum droop value and the process continues by going to the next, or second, data point through box 176. Referring to FIG. 23, in box 178, a determination is made as to whether the second data point is greater than the first data point. If it is, the value of the second data point is set in box 180 as the new, or current, maximum droop value. If the value of the second data point is not greater than the first data point, or if a new peak toe value has been set in box 180, a determination is made in box 182 as to whether the end of the downswing period, or the data set, has occurred. This process is continued until the end of the data set has been reached as determined in box 182 and the maximum droop value as set in box 180 is now recorded in box 184.

In box 186, the droop difference is determined by subtracting the maximum droop value from the droop value at the instant of impact. In box 188, the amount of forward, or positive, lead at the time of impact is determined by selecting the lead/lag data point value at the instant of impact.

Figure 17:
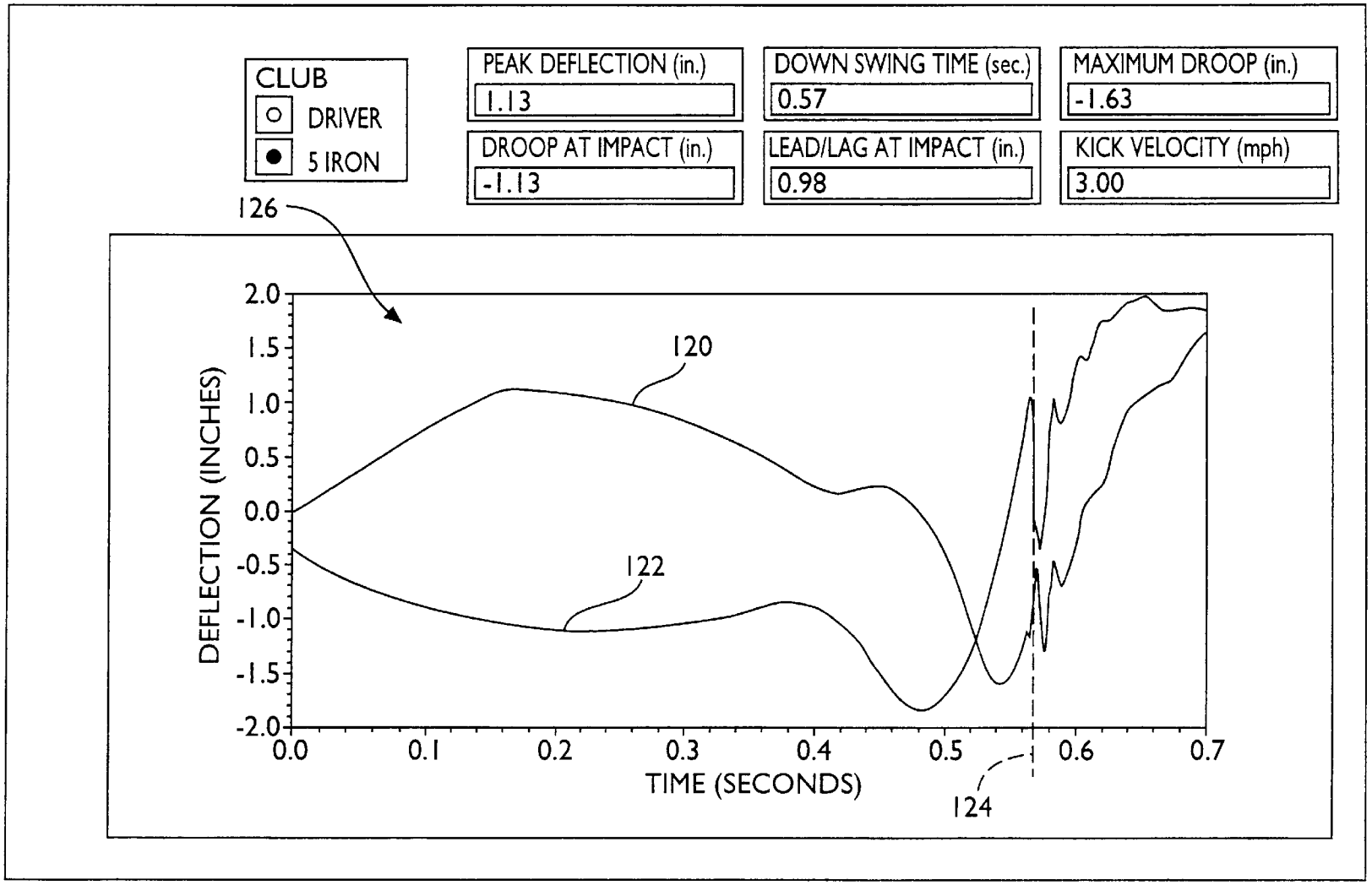
FIG. 17 is a front view of a monitor display showing a graph representing data acquired and processed during the downswinging of the golf club of FIG. 9 in accordance with certain principles of the invention.

In box 190, the kick velocity value is calculated in miles per hour as a derivative of the twenty data points occurring just before impact of the head 68 with the ball 56. In box 192, the collected, determined and calculated data is used to control, as shown in FIG. 8, the printer 118 and monitor 94. As shown in FIG. 17, the printer 118 and the monitor 94 respectively print and display a graph 126 which shows, in inches, a toe deflection curve 120 and a lead/lag curve 122 as they occur during the downswing period in seconds. The point of impact occurs at a time line 124 of the graph 126. The printer 118 and the monitor 94 are also controlled to display numerically the eight parameters noted above as shown in FIG. 17.

In box 194, the process of video recording is terminated where the camcorder 96 and the VCR 98 are manually turned off. In box 196, the foregoing process, which was followed by using the specialized driver 62, is again followed by using a specialized iron, typically a 5-iron, and the data point values collected and processed in the same manner.

Figures 14, 15, 16:
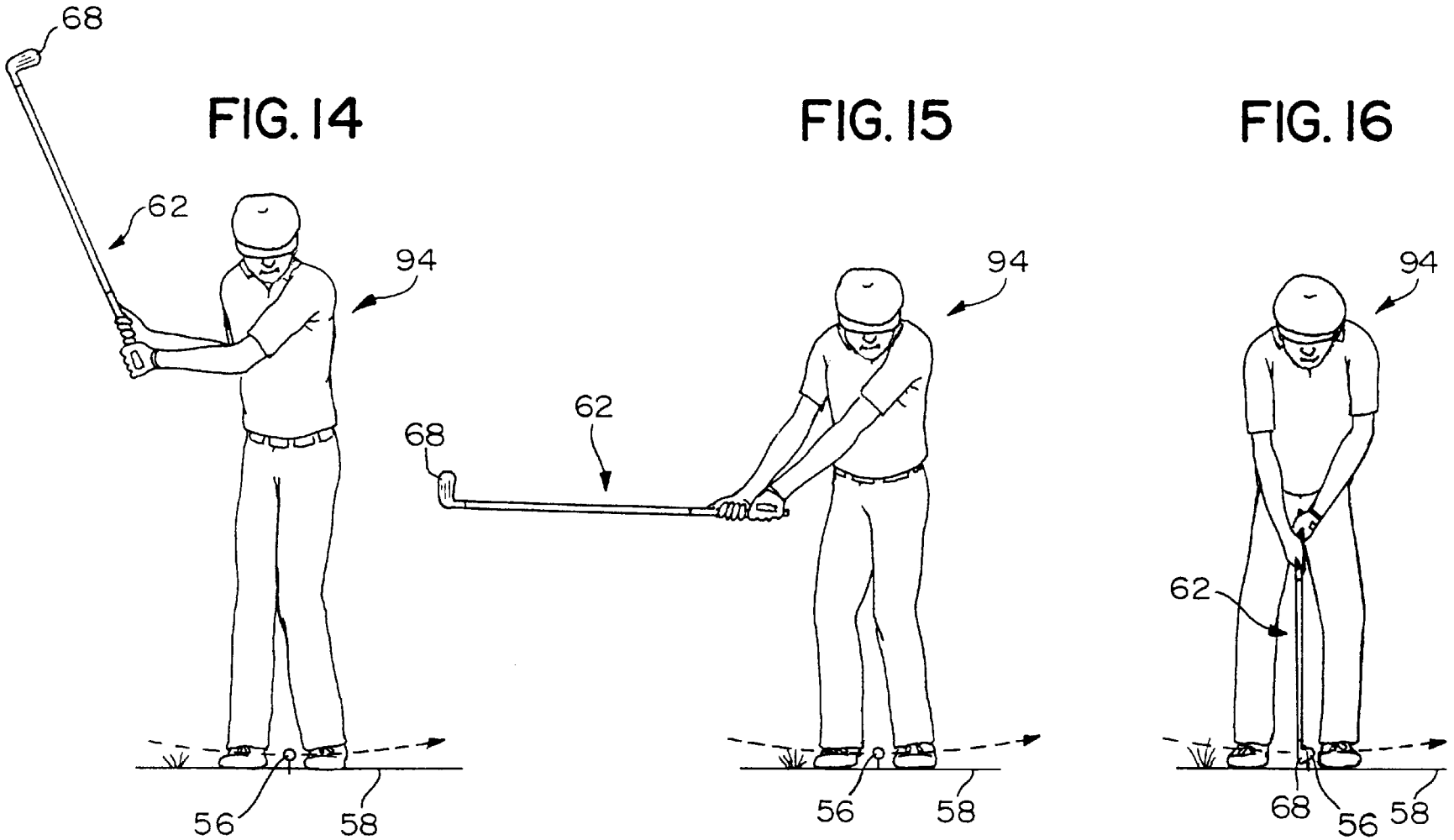
Figure 24:
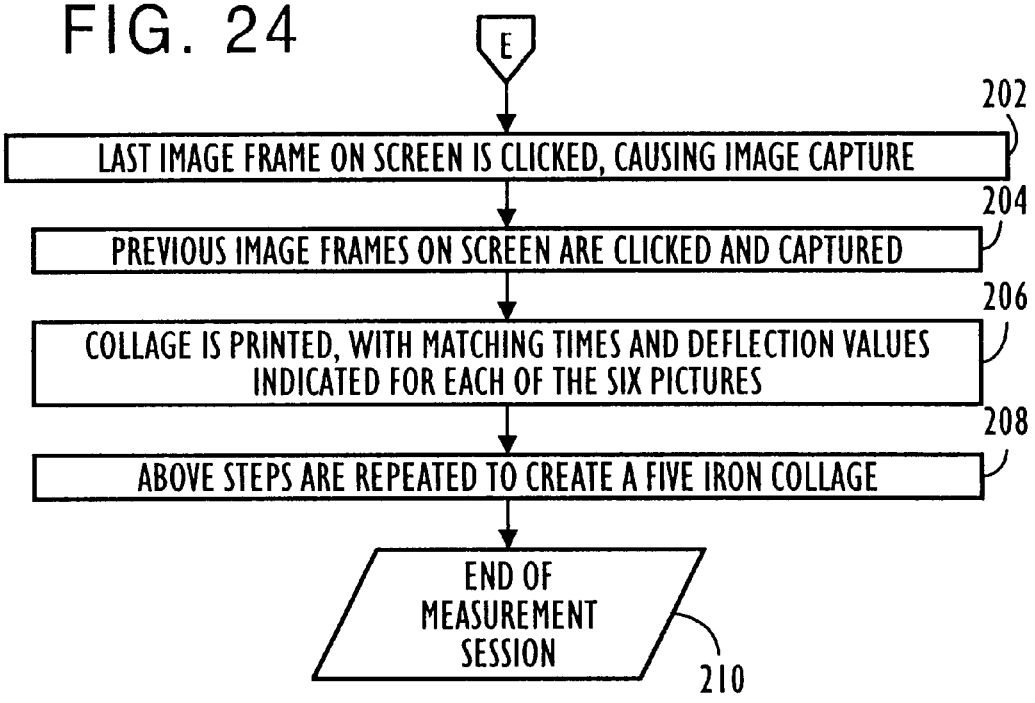

In box 198, software is executed for preparing a collage of six "still" images generally the same as the illustrations of FIGS. 11 through 16. In box 200, the tape in the VCR 98 is rewound and is stopped at a frame nearest the instant of impact of the head 68 of the specialized driver 62 with the ball 56, for example, as illustrated in FIG. 16. As shown in FIG. 24, in box 202, the operator of the system 60 facilitates the capture of a precise window in which an image is displayed. The capture of this window triggers the image acquisition unit 102 to process and feed the above-noted image (i.e., the image of the frame nearest the instant of impact) in a format acceptable to the CPU 76 for display of the image in the captured window.

The operator jogs the video tape in reverse for one or more frames and selects another image somewhat prior to the instant of impact, for example, as illustrated in FIG. 15, and facilitates the capture of a second window in which an image is displayed. The process of reverse-jogging of the video tape, and capturing of earlier windowed images, is continued in box 204 until a collage of six images, similar to the six illustrations of FIGS. 11 through 16, is obtained. The time, relative to the start of the downswing period, is displayed under each image. For example, if impact occurs at 0.50 second into the downswing period, this time would be displayed beneath the image.

The times of the earlier images (FIGS. 11 through 15), are determined by subtracting the duration between frames (i.e., one-thirtieth or 0.033 second) from the time of impact. Thus, if the penultimate image (FIG. 15) of the set of six images occurred one frame ahead of the impact frame (FIG. 16), the occurrence of the penultimate image into the downswing period would be determined by subtracting 0.033 from 0.50, or approximately 0.047 second. The times of the remaining four image windows would be calculated in an identical manner.

With the times of the occurrence of the six images into the downswing period being determined as noted above, the corresponding toe and lead/lag deflection values can be determined from the data previously collected. In box 206, the collage of six images and the relative times and deflection values of each image are printed. In box 208, the immediately preceding steps are followed to create a five-iron average.

While the collage of the above-noted example includes the selection of six "still" images from the many images stored on the video tape, more or less than six images could be selected for the swing analysis process without departing from the spirit and scope of the invention. Also, within a given downswing profile, the velocity of the swing is faster as the club head approaches impact with the ball than in the early stages of the downswing period. Therefore, the majority of selected images could be drawn from the later stages of the downswing period to allow for the illustration of a greater range of motion in the golfer's swing.

The personalized downswing load profiles obtained by a golfer when using the system 60 in the foregoing manner provide data which can be used to determine the flexural requirements of golf club shafts which will best accommodate the golfer's downswing profile.

In general, the above-identified embodiments are not to be construed as limiting the breadth of the present invention. Modifications, and other alternative constructions, will be apparent which are within the spirit and scope of the invention as defined in the appended claims.

What is claimed is:

1. An apparatus for obtaining compound bending data from the swinging of a golf club by a golfer, which comprises:

a golf club including a shaft and a head having a club face defining a plane;

a first sensing device mounted on the golf club shaft in a first prescribed alignment with respect to the club face;

a second sensing device mounted on the golf club shaft in a second prescribed alignment with respect to the club face and angularly displaced from the first sensing device;

the first and second sensing devices detecting compound bending of the golf club in prescribed directions during successive increments of a period when the golf club is swung prior to and during impact of the club head with a golf ball;

the first and second sensing devices including facility for producing incremental data representative of the compound bending of the golf club in the prescribed directions during the period;

a calculator responsive to the production of the incremental data by the first and second sensing devices for analyzing the data and calculating various parameters related to the instantaneous compound bending of the shaft during the period which are representative of the bending of the shaft in the prescribed directions; and a display responsive to and controlled by the calculator for displaying the calculated parameters.

2. The apparatus as set forth in claim 1, wherein the first sensing device includes means for developing a string of data relating to deflection of the shaft in the plane of the club face as the club is being swung, the deflection being referred to as the club toe deflection.

3. The apparatus as set forth in claim 1, wherein the second sensing device includes means for developing a string of data relating to a lead or lag position of the head with respect to the shaft as the club is being swung, the position of the head being referred to as the club lead/lag condition.

4. The apparatus as set forth in claim 2, wherein the string of data relating to the head deflection is a first string of data and the second sensing device further comprises means for developing a second string of data relating to a lead or lag position of the head with respect to the shaft as the club is being swung, the position of the head being referred to as the club lead/lag condition.

5. The apparatus as set forth in claim 2, wherein the data to be analyzed and displayed results from a portion of the swinging motion of the golf club referred to as a downswing, and wherein the calculator includes means for analyzing the string of data and for determining the initiation of the downswing based on the analysis of the string of data.

6. The apparatus as set forth in claim 3, wherein the data to be analyzed and displayed results from a portion of the swinging motion of the golf club referred to as a downswing and occurs prior to and at impact of a head of the club with a golf ball, and wherein the calculator includes means for analyzing the string of data and for determining the occurrence of the impact based on the analysis of the string of data.

7. The apparatus as set forth in claim 4, wherein the data to be analyzed and displayed results from a portion of the swinging motion of the golf club referred to as a downswing, and wherein the calculator comprises:

means for analyzing the first string of data and for determining the initiation of the downswing based on the analysis of the first string of data; and means for analyzing the second string of data and for determining the occurrence of the impact based on the analysis of the second string of data.

8. The apparatus as set forth in claim 7, wherein the means for analyzing the first string of data and the means for analyzing the second string of data combine to provide a means for establishing a downswing period during which the first and second strings of data are analyzed to calculate and provide the various parameters.

9. The apparatus as set forth in claim 1, wherein the first sensing device comprises:

a first strain gage located on the shaft of the golf club in general alignment with the plane of the club face whereby the first strain gage is flexed in response to the club toe deflection; and the second sensing device comprises:

a second strain gage located on the shaft of the golf club generally perpendicular to the plane of the club face whereby the second strain gage is flexed in response to the club lead/lag condition.

10. An apparatus for obtaining compound bending data from the swinging of a golf club by a golfer, which comprises:

a golf club including a head and a shaft;

a sensing device mounted on the golf club which detects compound bending of the golf club in prescribed directions during successive increments of a period when the golf club is swung prior to and during impact of the club head with a golf ball;

the sensing device including facility for producing incremental data representative of the compound bending of the golf club in the prescribed directions during the period;

a calculator responsive to the production of the incremental data by the sensing device for analyzing the data and calculating various parameters related to the instantaneous compound bending of the club during the period which are representative of the bending of the club in the prescribed directions;

a calibrating device for flexing the shaft of the club to a prescribed position to pre-establish a defined response from the sensing device;

an adjustment means within the calculator for adjusting the calculator to be calibrated with the defined response of the sensing device; and a display responsive to and controlled by the calculator for displaying the calculated parameters.

11. The apparatus as set forth in claim 10, wherein the head of the golf club is mounted on one end of the shaft and a grip is mounted on an opposite end of the shaft, and wherein the calibrating device comprises:

a platform;

locating means on the platform for receiving the grip of the club in a prescribed orientation;

deflection stop means for establishing a limit at which an intermediate portion of the shaft can be bent with respect to the locating means;

holding means for holding the head of the club at a precise location with respect to the deflection stop means; and club stressing means defined by the relative locations of the locating means, the deflection stop means and the holding means to establish the prescribed position of the club within the calibrating device during a period when the calculator and the sensing device are being calibrated.

12. The apparatus as set forth in claim 1, wherein the display shows the calculated parameters in a numeric readable format.

13. The apparatus as set forth in claim 1 wherein the display shows graphically instantaneous data with respect to deflection of the club head in the plane thereof as the club is being swung, and instantaneous data relating to a lead or lag position of the head with respect to the shaft as the club is being swung.

14. An apparatus for obtaining compound bending data from the swinging of a golf club by a golfer, which comprises:

a golf club including a head and a shaft;

a sensing device mounted on the golf club which detects compound bending of the golf club in prescribed directions during successive increments of a period when the golf club is swung prior to and during impact of the club head with a golf ball;

the sensing device including facility for producing incremental data representative of the compound bending of the golf club in the prescribed directions during the period;

a first calculator responsive to the production of the incremental data by the sensing device for analyzing the data and calculating various parameters related to the instantaneous compound bending of the club during the period which are representative of the bending of the club in the prescribed directions;

a display responsive to and controlled by the calculator for displaying the calculated parameters;

a video camera and video recording media for recording the motion of the club as the club is being swung and for storing each incremental movement of the club during the successive increments of the period when the golf club is swung prior to and during impact with the golf ball;

a second calculator for facilitating the selective capture of any incremental movement of the club; and the display being responsive to the selective capture of any incremental movement of the club for visually displaying as a still shot the club position at that increment of the period.

15. The apparatus as set forth in claim 14, wherein the display is further responsive to the precise time in which the still shot occurred during the period and is controlled to display such time with the visual display of the still shot of the club position.

16. An apparatus for obtaining compound bending data from the swinging of a golf club by a golfer, which comprises:

a golf club including a head and a shaft;

a sensing device mounted on the golf club which detects compound bending of the golf club in prescribed directions during successive increments of a period when the golf club is swung prior to and during impact of the club head with a golf ball;

the sensing device including facility for producing incremental data representative of the compound bending of the golf club in the prescribed directions during the period;

a calculator responsive to the production of the incremental data by the sensing device for analyzing the data and calculating various parameters related to the instantaneous compound bending of the club during the period which are representative of the bending of the club in the prescribed directions;

a display responsive to and controlled by the calculator for displaying the calculated parameters;

a high speed camera for taking a series of sequential still shots of the club being swung before and after impact by the head with the golf ball which provide a trajectory of the ball after impact; and the calculator being responsive to the series of sequential still shots and the trajectory of the ball for determining the travel distance the ball travels between impact of the head with the ball and impact of the ball with a distant surface at the end of the trajectory.

17. The apparatus as set forth in claim 16, which further comprises a printer for printing data relating to the club used to determine the travel distance and the travel distance attained.

18. The apparatus as set forth in claim 16, which further comprises a trigger device for sensing movement of the club at a precise location during the period when the club is swung and for initiating the operation of the high speed camera.

19. An appartus for obtaining compound bending data from the swinging of a golf club by a golfer, which comprises:

a golf club including a head and a shaft;

a sensing device mounted on the golf club which detects compound bending of the golf club in prescribed directions during successive increments of a swinging motion of the golf club;

means responsive to the detection by the sensing device of the compound bending of the club for developing a string of incremental data relating to deflection of the head in the plane thereof as the club is being swung, the deflection being referred to as the club toe deflection;

means for analyzing the string of data and for determining the initiation of at least a portion of the swinging motion of the club referred to as "the downswing;"

a calculator responsive to the production of the incremental data by the developing means for analyzing the data and calculating various parameters related to the instantaneous compound bending of the club during the downswing which are representative of the bending of the club in the prescribed directions; and a display responsive to and controlled by the calculator for displaying the calculated parameters.

20. An apparatus for obtaining compound bending data from the swinging of a golf club by a golfer, which comprises:

a golf club including a head and a shaft;

a sensing device mounted on the golf club which detects compound bending of the golf club in prescribed directions during successive increments of a swinging motion of the golf club;

means responsive to the detection by the sensing device of the compound bending of the club for developing a string of incremental data relating to a lead or lag position of the head with respect to the shaft as the club is being swung, the deflection being referred to as the club lead/lag condition;

means for analyzing the string of data and for determining the occurrence of the impact of the head with the ball to establish the termination of at least a portion of the swinging motion of the club referred to as "the downswing;"

a calculator responsive to the production of the incremental data by the developing means for analyzing the data and calculating various parameters related to the instantaneous compound bending of the club during the downswing which are representative of the bending of the club in the prescribed directions; and a display responsive to and controlled by the calculator for displaying the calculated parameters.

21. An apparatus for obtaining compound bending data from the swinging of a golf club by a golfer, which comprises:

a golf club including a head and a shaft;

a sensing device mounted on the golf club which detects compound bending of the golf club in prescribed directions during successive increments of a swinging motion of the golf club;

means responsive to the detection by the sensing device of the compound bending of the club for developing (1) a first string of incremental data relating to deflection of the head in the plane thereof as the club is being swung, the deflection being referred to as the club toe deflection, and (2) a second string of incremental data relating to a lead or lag position of the head with respect to the shaft as the club is being swung, the position of the head being referred to as the club lead/lag condition;

means for analyzing the first string of data and for determining the initiation of at least a portion of the swinging motion of the club referred to as "the downswing;"

means for analyzing the second string of data and for determining the occurrence of the impact of the head with the ball to establish the termination of the downswing of the club;

a calculator responsive to the production of the incremental data by the developing means for analyzing the data and calculating various parameters related to the instantaneous compound bending of the club during the downswing which are representative of the bending of the club in the prescribed directions; and a display responsive to and controlled by the calculator for displaying the calculated parameters.

22. The apparatus as set forth in claim 21, wherein the means for analyzing the first string of data and the means for analyzing the second string of data combine to provide a means for establishing a downswing period during which the first and second strings of data are analyzed to calculate and provide the various parameters.

* * * * *